US007666499B2

(12) United States Patent
Jung et al.

(10) Patent No.: US 7,666,499 B2
(45) Date of Patent: Feb. 23, 2010

(54) HIGH MODULUS POLYAMIDE FIBERS

(75) Inventors: Dongwook Jung, Raleigh, NC (US); Richard Kotek, Raleigh, NC (US); Alan E. Tonelli, Cary, NC (US); Nadarajah Vasanthan, Princeton, NJ (US)

(73) Assignee: North Carolina State University, Raleigh, NC (US)

( * ) Notice: Subject to any disclaimer, the term of this patent is extended or adjusted under 35 U.S.C. 154(b) by 415 days.

(21) Appl. No.: 11/528,701

(22) Filed: Sep. 27, 2006

(65) Prior Publication Data

US 2007/0210482 A1 Sep. 13, 2007

Related U.S. Application Data

(60) Provisional application No. 60/721,837, filed on Sep. 28, 2005.

(51) Int. Cl.
*D02G 3/00* (2006.01)

(52) U.S. Cl. ..... 428/364; 428/394

(58) Field of Classification Search ..... 428/364, 428/394

See application file for complete search history.

(56) References Cited

U.S. PATENT DOCUMENTS 4,379,773 A 4/1983 Danzik et al.
4,440,711 A 4/1984 Kwon et al.
4,552,805 A * 11/1985 Fish et al. ..... 428/297.4
4,584,240 A * 4/1986 Herbert et al. ..... 428/373
4,836,828 A * 6/1989 Hussamy ..... 8/594
5,077,124 A * 12/1991 Clark et al. ..... 428/364
5,104,969 A * 4/1992 Clark et al. ..... 528/323
5,106,946 A * 4/1992 Clark et al. ..... 528/335
5,139,729 A * 8/1992 Clark et al. ..... 264/289.6
5,202,182 A * 4/1993 Knox et al. ..... 428/364
5,302,452 A * 4/1994 Kai et al. ..... 428/364
5,376,712 A * 12/1994 Nakajima ..... 524/492
6,290,888 B1 * 9/2001 Kawai ..... 264/184
6,548,591 B2 * 4/2003 Koning et al. ..... 524/494
6,605,655 B1 * 8/2003 Kato et al. ..... 523/203
6,936,682 B2 * 8/2005 Aramaki et al. ..... 528/310
7,273,578 B1 * 9/2007 Slutsker et al. ..... 264/289.6
7,485,363 B2 * 2/2009 Guevel et al. ..... 428/359

FOREIGN PATENT DOCUMENTS

WO WO2007/038597 4/2007

OTHER PUBLICATIONS

International Search Report and Notification of Transmittal dated May 24, 2007.

(Continued)

*Primary Examiner*—N. Edwards
(74) *Attorney, Agent, or Firm*—Jenkins, Wilson, Taylor & Hunt, P.A.

(57) ABSTRACT

A process for preparing high initial modulus and high tensile strength polyamide fibers is described. The process comprises complexing the polyamide with a Lewis acid, dry-jet wet spinning the complexed fibers, drying the spun fibers for a period of time, drawing the fibers, and soaking the fibers in solvent to remove the Lewis acid. High molecular weight nylon 6,6 fibers prepared according to the described process show initial moduli of up to 30.1 GPa and tenacities of up to 2.5 GPa.

4 Claims, 6 Drawing Sheets

OTHER PUBLICATIONS

Jung, Dongwook, "New Methods for Producing Nylong 6,6 Fibers with Enhanced Mechanical Properties," North Carolina State University, vol. 65/11-B, Dec. 2004.
Kotek et al., "Lewis Acid-Base Complexation of Polyamides and the Effect of Hydrogen Bonding on Structure Development," *National Textile Center*, Project No. M01-NS03, Report III and IV, Oct. 1, 2004.
Kotek et al., "Lewis Acid-Base Complexation of Polyamides and the Effect of Hydrogen Bonding on Structure Development," *National Textile Center Annual Report*, NTC Project No. M01-NS03, Nov. 2004.
Kotek et al., "Novel Methods for Obtaining High Modulus Aliphatic Polyamide Fibers," *Polymer Reviews* vol. 45, Issue 3, pp. 201-230, Jul. 2005.
Tonelli et al., "NC State Textile Researchers Create Super-Strong Nylon Fibers," *NC State University News*, Sep. 23, 2004.
Vasanthan et al., "Lewis Acid-Base Complexation of Polyamide 66 to Control Hydrogen Bonding, Extensibility and Crystallinity," *Polymer*, vol. 45, pp. 4077-4085, 2004.
Jung, DongWook, High Modulus Polyamide 66 Fibers Through Lewis Acid-Base Complexation to Control Hydrogen Bonding and Enhance Drawing Behavior. *Abstract of Presentation to the 228th National Meeting of the American Chemical Society*. Aug. 2004.
Jung, DongWook, High Modulus Polyamide 66 Fibers Through Lewis Acid-Base Complexation to Control Hydrogen Bonding and Enhance Drawing Behavior. *Presentation to the 228th National Meeting of the American Chemical Society*. Aug. 22, 2004.
Kotek et al., Lewis Acid-Base Complexation of Polyamides and the Effect of Hydrogen Bonding on Structure Development. *National Textile Center Annual Report* (*online*): Nov. 2002.
Kotek et al., Lewis Acid-Base Complexation of Polyamides and the Effect of Hydrogen Bonding on Structure Development. *National Textile Center Annual Report* (*online*): Nov. 2003.
Kotek et al., Lewis Acid-Base Complexation of Polyamides and the Effect of Hydrogen Bonding on Structure Development. *National Textile Center Research Briefs—Materials Competency* (*online*): Jun. 2003.
Kotek et al., Lewis Acid-Base Complexation of Polyamides and the Effect of Hydrogen Bonding on Structure Development. *National Textile Center Research Briefs—Materials Competency* (*online*): Jun. 2004.
Kotek et al., Lewis Acid-Base Complexation of Polyamides and the Effect of Hydrogen Bonding on Structure Development. *National Textile Center Research Briefs* (*online*); Jun. 2002.
NC State Researchers Create Super-Strong Nylon Fibers. *Textile News*(article) Nov. 22, 2004.
Notification Concerning Transmittal of International Preliminary Report on Patentability (Chapter I of the Patent Cooperation Treaty) corresponding to International Application No. PCT/US2006/037674 dated Apr. 10, 2008.
Vasanthan et al., Lewis Acid-Base Complexation of Polyamide 66 as a Means to Control Hydrogen Bonding to Form High Strength Fibers and Films. Abstracts of the Division of Polymer Chemistry. *227th National Meeting of the American Chemical Society*. Mar. 2004.
Afshari et al., Properties of films and fibers obtained from Lewis acid—base complexed nylon 6,6. *Polymer*. vol. 49 pp. 1297-1304 (2008).
Bianchi et al., Bulk Properties of Synthetic Polymer-Inorganic Salt Systems. II. Crystallization Kinetics of Salted Poly(caproamide). *Macromolecules*. vol. 7, No. 4 pp. 495-500 (1974).
Cho et al., Mechanical Properties of Nylon 6 Fibers Gel-Spun from Benzyl Alcohol Solution. *Journal of Applied Polymer Science*. vol. 63 pp. 771-778 (1996).
Chuah, H.H. and Porter, R.S., A new drawing technique for nylon-6 by reversible plasticization with iodine. *Polymer*. vol. 72 pp. 241-246 (1986).
Chuah, H.H. and Porter, R.S., Solid-state co-extrusion of nylon-6 gel. *Polymer*. vol. 27 pp. 1022-1029 (1986).
Gogolewski, S. and Pennings, A.J., High-modulus fibres of nylon-6 prepared by a dry-spinning method. *Polymer*. vol. 26 pp. 1394-1400 (1985).
Gogolewski, S. and Pennings, A.J., Resorbable Materials of Poly(L-Lactide). II. Fibers Spun from Solutions of Poly(L-Lactide) in Good Solvents. *Journal of Applied Polymer Science*vol. 28 pp. 1045-1061 (1983).
Hancock et al., Wet Spinning of Aliphatic and Aromatic Polyamides. *Journal of Applied Polymer Science*. vol. 21, pp. 1227-1247 (1977).
Kunugi et al., Mechanical properties and superstructure of high-modulus and high-strength nylon-6 fibre prepared by the zone-annealing method. *Polymer*. vol. 23 pp. 1199-1203 (1982).
Kunugi et al., Preparation of high-modulus and high-strength nylon-6 fibre by the zone-annealing method. *Polymer*. vol. 23 pp. 1193-1198 (1982).
Kunugi et al., Preparation of High-Modulus Nylon 6 Fibers by Vibrating Hot Drawing and Zone Annealing. *Journal of Applied Polymer Sicence*. vol. 67 pp. 1993-2000 (1998).
Leenslag, J.W. and Pennings, A.J., High-strength poly(L-lactide) fibres by a dry-spinning/hot-drawing process. *Polymer*. vol. 28 pp. 1695-1702 (1987).
Murthy, Structure of Iodide Ions in Iodinated Nylon 6 and the Evolution of Hydrogen Bonds between Parallel Chains in Nylon 6. *Macromolecules*. vol. 20, No. 2 pp. 309-316 (1987).
Murthy et al., Structure of Iodide Ion Arrays in Iodinated Nylon 6 and the Chain Orientation Induced by Iodine in Nylon 6 Films. *Journal of Polymer Science: Polymer Physics Edition*. vol. 23 pp. 2369-2376 (1985).
Murthy et al., X-ray Diffraction and Nuclear Magnetic Resonance Studies of Nylon 6/$I_2$/Kl Complexes and Their Transformation into the γ Crystalline Phase. *Macromolecules*. vol. 23, No. 5 pp. 1342-1346 (1990).
Pennings et al., Process of Preparation and Properties of Ultra-High Strength Polyethylene Fibers. *Pure and Applied Chemistry*. vol. 55, No. 5 pp. 777-798 (1983).
Roberts, M.F. and Jenekhe, S.A., Lewis Acid Complexation of Polymers: Gallium Chloride Complex of Nylon 6. *Chemical Materials*. vol. 2, No. 3 pp. 224-226 (1990).
Roberts, M.F. and Jenekhe, S.A., Site-Specific Reversible Scission of Hydrogen Bonds in Polymers. An Investigation of Polyamides and Their Lewis Acid-Base Complexes by Infrared Spectroscopy. *Marcomolecules*. vol. 24 pp. 3142-3146 (1991).
Seidel et al., Regenerated Spider Silk: Processing, Properties, and Structure. *Macromolecules*. vol. 33 pp. 775-780 (2000).
Smith et al., Ultrahigh-Strength Polyethylene Filaments by Solution Spinning and Hot Drawing. *Polymer Bulletin*. vol. 1 pp. 733-736 (1979).
Smith, P. and Lemstra, P.J., Ultra-high-strength polyethylene filaments by solution spinning/drawing. *Journal of Materials Science*. vol. 15 pp. 505-514 (1980).
Smith, P. and Lemstra, P.J., Ultrahigh-Strength Polyethylene Filaments by Solution Spinning/Drawing, 2[a)] Influence of Solvent on the Drawability. *Makromol. Chem*. vol. 180 pp. 2983-2986 (1979).
Smook et al., A Semiempiric Model for Establishing the Drawability of Solution-Spun Linear Polyamides and Other Flexible Chain Polymers. *Journal of Applied Polymer Science*. vol. 41 pp. 105-116 (1990).
Suzuki, A. and Endo, A., Preparation of high modulus nylon 46 fibres by high-temperature zone-drawing. *Polymer*. vol. 38, No. 12 pp. 3085-3089 (1997).
Suzuki, A. and Ishihara, M., Application of $CO_2$ Laser Heating Zone Drawing and Zone Annealing to Nylon 6 Fibers. *Journal of Applied Polymer Science*. vol. 83 pp. 1711-1716 (2002).
Suzuki et al., Application of high-tension annealing method to nylon 66 fibres. *Polymer*. vol.39, Nos. 6-7 pp. 1351-1355 (1998).
Valenti et al., Bulk Properties of Synthetic Polymer-Inorganic Salt Systems. IV. Role of the Polymeric Substrate. *Macromolecules*. vol. 9, No. 1 pp. 117-122 (1976).
Valenti et al., Bulk Properties of Synthetic Polymer-Inorganic Salt Systems. Melting Behavior of Salted Poly(caproamide). *The Journal of Physical Chemistry*. vol. 77, No. 3 pp. 389-395 (1973).
Vasanthan et al., Lewis acid—base complexation of polyamide 66 to control hydrogen bonding, extensibility and crystallinity. *Polymer*. vol. 45 pp. 4077-4085 (2004).
Vollrath, F. and Knight, D. P., Liquid crystalline spinning of spider silk. *Nature*. vol. 410 pp. 541-548 (2001).

Wu et al., FT-IR Spectroscopic Investigation on the Interaction Between Nylon 66 and Lithium Salts. *Journal of Applied Polymer Science*. vol. 91 pp. 2869-2875 (2004).
Xie et al., The coordination and phase separation in nylon-copper chloride system. *Journal of Molecular Structure*. vol. 613 pp. 67-71 (2002).
Xu et al., Investigation on the Interaction between Polyamide and Lithium Salts. *Journal of Applied Polymer Science*. vol. 77 pp. 2685-2690 (2000).
Zachariades, A.E. and Kanamoto, T., New Model for the High Modulus and Strength Performance of Ultradrawn Polyethylenes. *Journal of Applied Polymer Science*. vol. 35 pp. 1265-1281 (1988).
Zachariades, A.E. and Porter, R.S., Reversible Plasticization of Nylons 6 and 11 with Anhydrous Ammonia and Their Deformation by Solid-State Coextrusion. *Journal of Applied Polymer Science*. vol. 24 pp. 1371-1382 (1979).
Zachariades et al., Ultradrawing of Amorphous Polymers by Coextrusion Illustrated with Atactic Polystyrene. *Journal of Applied Polymer Science*. vol. 24 pp. 2137-2146 (1979).
Abu-Isa, α-γ Transition in Nylon 6. *Journal of Polymer Science*. vol. 9 pp. 199-216 (1971).
Acierno et al., Bulk Properties of Synthetic Polymer-Inorganic Salt Systems. V. Mechanical Properties of Oriented Poly(Caproamide). *Journal of Polymer Science*. vol. 17 pp. 1903-1912 (1979).
Arimoto et al., Crystal Structure of the γ-Form of Nylon 6. *Journal of Polymer Science*. vol. 3 pp. 317-326 (1965).
Burzynski et al., Structure of Iodine Columns in Iodinated Nylon-6. *Journal of Polymer Science: Polymer Physics Edition*. vol. 24 pp. 133-141 (1986).
Frayer et al., Infrared Studies of Chain Folding in Polymers. X. Polycaprolactam. *Journal of Macromolecular Science: Physics*. vol. B6, No. 1 pp. 129-149 (1972).
Jung et al. High Modulus Nylon 66 Fibers through Lewis Acid-Base Complexation to Control Hydrogen Bonding and Enhance Drawing Behavior. *Polymeric Materials: Science And Engineering*. vol. 91 pp. 354-355 (2004).
Kunugi et al., Preparation of ultra-high-strength nylon-6 fibre by a multi-step zone-annealing method. *Polymer*. vol. 23 pp. 1983-1987 (1982).
Posterna, A.R., and Smith, P. Ultra-drawing of polyamides: the hydrogen bond barrier. *Polymer Communications*. vol. 31 pp. 444-447 (1990).
Vogelsong, Crystal Structure Studies on the Polymorphic Forms of Nylons 6 and 8 and Other Even Nylons. *Journal of Polymer Science: Part A*. vol. 1 pp. 1055-1068 (1963).

* cited by examiner

HIGH MODULUS POLYAMIDE FIBERS

CROSS REFERENCE TO RELATED APPLICATIONS

This application claims the benefit of and priority to U.S. Provisional Patent Application Ser. No. 60/721,837, filed Sep. 28, 2005, the disclosure of which is incorporated herein by reference in its entirety.

GOVERNMENT INTEREST

A portion of the disclosure contained herein was made with U.S. Government support from the National Textile Center Grant No. M0-NS03 and Grant No. M05-NS05. The U.S. Government has certain rights to that portion of the disclosure.

TECHNICAL FIELD

The presently disclosed subject matter generally relates to a method of preparing high modulus polyamide fibers and the fibers, themselves. In particular, high modulus, high tenacity nylon 6,6 fibers are prepared by dry jet wet spinning of a spinning dope prepared from a Lewis acid complex of high molecular weight polymer prepared from solid state polymerization.

ABBREVIATIONS

Å=angstrom
° C.=degrees Celsius
K=degrees Kelvin
Al=aluminum
As=arsenic
ATR=attenuated total reflectance
$CaCl_2$=calcium chloride
DR=draw ratio
Fe=iron
FTIR=Fourier Transform Infrared
g=grams
Ga=gallium
GPa=gigapascal
KI=potassium iodide
LiCl=lithium chloride
m=meters
MCT=mercury cadmium telluride
MeOH=methanol
min=minutes
mm=millimeters
mol=moles
MW=molecular weight
N66=nylon 6,6
NMR=nuclear magnetic resonance
psi=pounds per square inch
s=seconds
Sb=antimony
SEM=scanning electron microscope
SSP=solid state polymerization
Tg=glass transition temperature UHMWPE=ultra high molecular weight polyethylene
WAXS=wide angle X-ray scattering
XRD=x-ray diffraction

BACKGROUND

A number of attempts for producing high modulus fibers have been made. See Ciferri, A., and Ward, I. M., Eds., *Ultra-High Modulus Polymers* (London: Applied Science, 1979). Zachariades, A. E., and Kanamoto, T., *J. Appl. Polym. Sci.,* 35, 1265-1281 (1988); Smith, P., et al., *Polym. Bull.,* 1, 733-736, (1979); Pennings, A. J., et al., *Pure Appl. Chem.,* 55, 777-798 (1983); Smith, P., and Lemstra P. J., *J. Mater. Sci.,* 15, 505-514 (1980); Leenslag, J. W., and Pennings, A. J., *Polymer,* 28, 1695-1702 (1987); Gogolewski, S., and Pennings, A. J., *Polymer,* 26, 1394-1400 (1985). Two general methods exist for producing high modulus fibers. The first method involves the synthesis and assembly of polymers with inherently rigid and linear backbone molecular structures. The second method transforms conventional inherently flexible semicrystalline polymers that usually have relatively low modulus and strength, into highly oriented materials. In the first case, para-substituted aromatic rings in the polymer backbone are used. These rigid polymers can produce fibers of very high stiffness and strength, either by wet spinning to produce aramid fibers or by melt spinning if thermotropic liquid crystalline polymers are used. In the second case, flexible chains of semicrystalline polymers must be converted into highly oriented and extended chain conformations. The main technique for developing an oriented and extended polymer structure is the drawing process. Ultra drawn high molecular weight polyethylene (UHMWPE) is one good example. By drawing UHMWPE more than 200 times, moduli approaching the theoretical value for the draw ratio have been obtained. See Zachariades, A. E., and Kanamoto, T., *J. Appl. Polym. Sci.,* 35, 1265-1281 (1988).

Unlike polyethylene, polyamides have hydrogen bonds between molecular chains. Hydrogen bonds play an important role to make polyamides engineering plastics. At the same time, hydrogen bonds prohibit high draw ratio processing in polyamides, which have a maximum draw ratio of approximately 5. See Postema, A. R., and Smith, P., *Polym. Commun.,* 31, 444-447 (1990). Therefore, highly oriented polyamides obtained by tensile drawing must be made either by suppression of crystallinity or by modification of the number and strength of the hydrogen bonds between their chains.

Many researchers have attempted to overcome the low maximum draw ratio of polyamides by using various processing techniques, such as, plasticizers, dry spinning, gel spinning, wet spinning, and zone drawing and annealing. See Chuah, H. H., and Porter. R. S., *Polymer,* 27, 241-246 (1986); Kanamoto, T., et al., *J. Polym. Sci. Polym. Phys. Edn.,* 20, 1485-1496 (1982); Chuah, H. H., and Porter, R. S., *Polymer,* 27, 1022-1029 (1986); Cho, J. W., et al., *J. Appl. Polym. Sci.,* 62, 771-778 (1996); Kunugi, T., et al., *Polymer,* 23, 1193-1198 (1982); Kunugi, T., et al., *Polymer,* 23, 1199-1203 (1982); Kunugi, T., et al., *Polymer,* 24, 1983-1987 (1983); Kunugi, T., et al., *J. Appl. Polym. Sci.,* 67, 1993-2000 (1998); Suzuki, A., et al., *Polymer,* 39, 1351-1355 (1998); Suzuki, A., et al., *Polymer,* 38, 3085-3089 (1997); Suzuki, A. and Ishihara, M., *J. Appl. Polym. Sci.,* 83, 1711-1716 (2002); Smook, J., et al., *J. Appl. Polym. Sci.,* 41, 105-116 (1990).

Aliphatic polyamides like nylon 6 and nylon 6,6 are important commercial thermoplastics with good mechanical properties. In applications needing increased performance, however, such as, for example, in ballistic vests, nylon tire cords, ropes, safety nets, and parachutes, fibers with even more superior qualities are desired. Thus, there is a continued need for improved methods to produce high modulus nylon fibers.

SUMMARY

The presently disclosed subject matter describes a process for obtaining high modulus polyamide fibers by spinning fibers from solutions containing polyamide in which intermolecular hydrogen bonding has been reversibly suppressed by complexing the polyamide with a Lewis acid. The process further comprises spinning the solution containing the polyamide:Lewis acid complex using a dry-jet wet spinning technique, drying the fibers for a period of time, drawing the fibers and then soaking the fibers in a suitable solvent, such as water, to decomplex the polyamide. In some embodiments, the solution containing the polyamide: Lewis acid is conditioned for a period of time prior to spinning.

In some embodiments, the polyamide is an aliphatic polyamide. In some embodiments, the polyamide is nylon 6,6. In some embodiments, the nylon 6,6 is a high molecular weight nylon 6,6 prepared according to a solid-state polymerization method. In some embodiments, the nylon has a molecular weight (MW) of between about 100,000 g/mol and 2,000,000 g/mol. In some embodiments, the nylon 6,6 has a molecular weight of about 160,000 g/mol to about 180,000 g/mol.

In some embodiments, the polyamide:Lewis acid complex is a nylon 6,6:$GaCl_3$ complex. In some embodiments, the polyamide:Lewis acid complex is formed in a solution comprising a polar solvent. In some embodiments, the polar solvent is nitromethane. Further, the presently disclosed method for preparing a nylon 6,6 fiber also can be applied to different Lewis acid complexation systems, such as, but not limited to, LiCl and nitromethane; $CaCl_2$ and nitromethane; and $CaCl_2$ and formic acid for nylon 6,6 complexation.

In some embodiments the polyamide is mixed with the Lewis acid solution at a temperature of between about 60° C. and about 70° C. for about one day. In some embodiments, the complex solution is further conditioned by remaining under an anhydrous atmosphere at room temperature for a period of about one day to provide a conditioned complex solution that is essentially free of bubbles. In some embodiments, the complex solution comprises about 4.5% by weight polyamide:Lewis acid complex.

In some embodiments, the solution containing the polyamide:Lewis acid complex is extruded at a temperature of about 40° C. to about 65° C. In some embodiments, the solution is extruded at a pressure of about 150 psi. In some embodiments, the extruded fibers are passed through a coagulation bath consisting of one or more of an alcohol, water or a combination of water and alcohol. In some embodiments, the coagulation bath comprises 2-propanol. Also, the presently disclosed method can be carried out by extruding the complex solution using spinnerets having a plurality of holes, through which filaments for yarn can be spun.

In some embodiments, the extruded fibers are dried for at least one day prior to drawing. In some embodiments, the dried fibers are drawn at a rate of about 0.2 inches per minute. In some embodiments, the drawn fibers are decomplexed by being soaked in water for about one day, regenerating a polymer essentially free from the Lewis acid.

In some embodiments, the presently disclosed process provides polyamide fibers, particularly nylon fibers having high draw ratios and very high initial moduli and tensile strength. In some embodiments, the process provides fibers having draw ratios of between about 4 and about 7.5. In some embodiments, the process provides nylon 6,6 fibers having an initial modulus of at least about 30.1 GPa and a tensile strength of at least about 2.5 GPa.

Fibers produced by the presently disclosed method can be used as technical fibers, such as for use as ballistic vests, nylon tire cord, ropes, monofilaments, parachutes, and the like. The process of forming a conditioned polyamide:Lewis acid complex also can be applied to preparing and drawing films. For example, the nylon 6,6 films having a draw ratio up to about 40 can be prepared from complex solutions of low molecular weight nylon 6,6 (e.g., approximately 30,000 g/mole).

DETAILED DESCRIPTION

Figure 1:
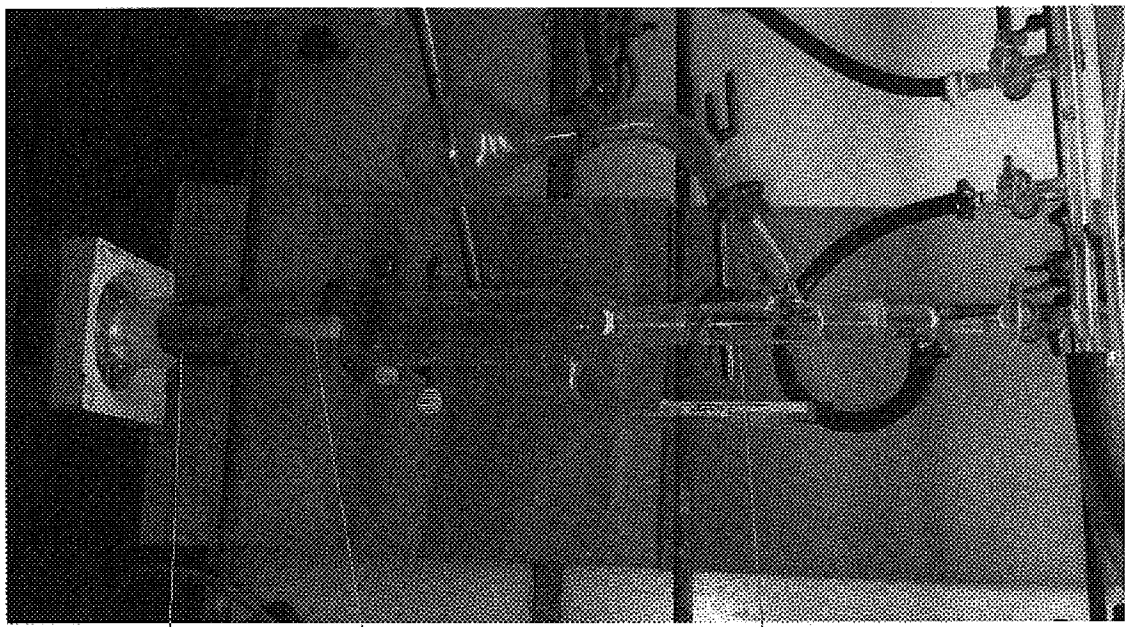
FIG. 1 is a photograph of a reaction apparatus for preparing high molecular weight nylon 6,6 by the presently disclosed solid-state polymerization method.

The presently disclosed subject matter will now be described more fully hereinafter with reference to the accompanying Examples, in which representative embodiments are shown. The presently disclosed subject matter can, however, be embodied in different forms and should not be construed as limited to the embodiments set forth herein. Rather, these embodiments are provided so that this disclosure will be thorough and complete, and will fully convey the scope of the embodiments to those skilled in the art.

Unless otherwise defined, all technical and scientific terms used herein have the same meaning as commonly understood by one of ordinary skill in the art to which this presently described subject matter belongs. All publications, patent applications, patents, and other references mentioned herein are incorporated by reference in their entirety.

I. Definitions

Following long-standing patent law convention, the terms "a", "an", and "the" refer to "one or more" when used in this application, including the claims.

Unless otherwise indicated, all numbers expressing quantities of ingredients, reaction conditions, and so forth used in the specification and claims are to be understood as being modified in all instances by the term "about". Accordingly, unless indicated to the contrary, the numerical parameters set forth in this specification and attached claims are approximations that can vary depending upon the desired properties sought to be obtained by the presently disclosed subject matter. Thus, the term "about", as used herein when referring to a value or to an amount of mass, weight, time, volume, or percentage is meant to encompass variations of ±20% or ±10%, more preferably ±5%, even more preferably ±1%, and still more preferably ±0.1% from the specified amount, as such variations are appropriate to perform the disclosed method.

The terms "complex," "complexed," and variations thereof as used herein refer to a solution, fiber, film or other substance comprising Lewis acid/Lewis base pairs. Thus, the term complex can refer to a mixture of a Lewis acid, such as a metal halide, for example, calcium, gallium, aluminum, iron, antimony, or arsenic halide, and a polymer containing a group, such as an amide linkage, capable of forming such a complex by donating a pair of electrons The terms "regenerate," "regenerated," and variations thereof as used herein refer to a polymer solution, film, or fiber that was part of a complex with a Lewis acid, but from which the Lewis acid has been removed. The terms "regenerated" and "decomplexed" can be used interchangeably.

Nylon 6,6 refers to the polyamide having a repeat unit of the formula:

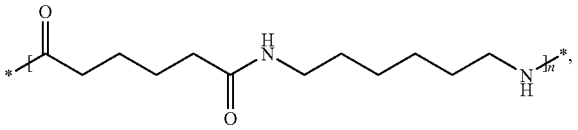

wherein * indicates the point of attachment to another repeating unit.

Nylon 6 refers to the polyamide having a repeat unit of the formula:

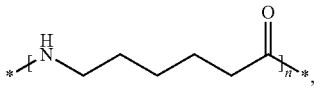

wherein * indicates the point of attachment to another repeating unit.

The term "high molecular weight polymer" as used herein refers to polymer that has been prepared by solid-state polymerization. For example, "high molecular weight polymer" includes nylon 6,6 having a molecular weight of greater than about 100,000 g/mol but not higher than 2,000,000 g/mol.

The term "low molecular weight polymer" as used herein generally refers to a readily available commercial polymer. For example, "low molecular weight polymer" includes nylon 6,6 having a molecular weight of 15,000 to 30,000 g/mol.

II. General Considerations

Over the past many years, numerous advances have been made in the development of polymeric fibers for high performance engineering applications. To date, two major research directions have been taken to produce high performance fibers. The first direction involves the production of new fibers from new polymers, or by special techniques different from traditional melt, wet, and dry spinning. For example, attempts have been made to produce high performance fibers through the processing of rigid rod or liquid crystalline polymers like Zylon® (Toyobo Co., Ltd., Osaka, Japan) PBO, Vectran® (Kuraray America, Inc., New York, N.Y., United States of America), and Kevlar® (E. I. duPont de Nemours and Co., Wilmington, Del., United States of America). Attempts also have been made to process flexible chain polymers like polyesters, polyamides, and polyolefins into highly oriented structures. The second major research direction involves the use of man made silks and silk like polymers based on biotechnology for novel high performance, but low productivity and high cost make the application of such technology less attractive. See Vollrath, F., and Knight, D. P., *Nature,* 410, 541 (2001); Seidal, A., et al., *Macromolecules,* 33, 775 (2000). Very recently, another direction also has been considered, which makes use of conventional semicrystalline polymers to improve fiber properties at a reasonable cost.

Various draw techniques have been used to produce highly oriented structures from flexible chain polymers which include solid-state extrusion, solid-state co-extrusion, solution and gel spinning, and zone drawing and annealing techniques. See Predecki, P., and Statton, W. O., *J. Polym. Sci., Polym. Lett. Ed.,* 10, 87 (1972); Zachariades, A. E., and Porter, R. S., *J. Appl Polym Sci.,* 24,2137 (1979); Wijnenburg, A., and Pennings, A. J., *J. Colloid Polym Sci.,* 253, 452, (1975); Smith, P., and Lemstra, J., *Makromol. Chem.,* 180, 2983, (1979); and Kunugi, T., et al., *Polym Preprints., Am Chem. Soc.,* 20, 778 (1979). Most of these techniques use multiple drawing stages to achieve high levels of orientation. It is required that a mechanism or means of relaxation must be sought which allows for drawing to occur in later stages.

Gel spinning has proved to be a very important technique in the case of high molecular weight polyethylene, for producing high strength and high modulus fibers from flexible chain polymers. See Smith, P., et al., *Polym. Bull.,* 1, 733-736 (1979); Pennings, A. J., et al., *Pure Appl. Chem.,* 55, 777-798 (1983); Smith, P., and Lemstra, P. J., *J. Mater. Sci.,* 15, 505-514 (1980). The important aspect of gel spinning is that it offers a possibility of drawing a polymer, which is composed of a very dilute entanglement network to extremely high draw ratios. Smith and Lemstra also have shown that by using appropriate solvents it is possible to reduce the entanglement density of molecular chains in polyethylene and hence permit super drawing. A similar process also is applicable for processing polyacrylonitrile, polyvinyl alcohol and poly-L-lactic acid. See European Patent Application 144793 to Kwon, Y. D., et al.; U.S. Pat. No. 4,440,711 to Kwon, Y. D., et al.; Leenslag, J. W., and Pennings, A. J., *Polymer,* 28,1695-1702 (1987).

For polyamides, however, solution spinning has not proven very effective. It has been shown that in spite of applying the solvent spinning procedure, the drawability of polyamides cannot be improved due to the restrictions imposed on chain movement by intermolecular hydrogen bonding. See Smook, J., et al., *J. Appl. Polym. Sci.,* 41, 105, (1990). Using dry spinning, tensile strengths of up to 1 GPa and moduli of up to 16-19 GPa with a draw ratio of 10 have been obtained for ultra high molecular weight nylon 6. See Gogolewski, S. and Pennings, A. J., *Polymer,* 26, 1394, (1985). Applying the gel spinning/drawing technique to nylon 6 using benzyl alcohol as a solvent has resulted in a draw ratio of 5-6 and an initial modulus of 6.2 GPa. See Cho, J. W., et al., *J. Appl. Polym. Sci.,* 1996, 62, 771-778 (1996). Wet spinning in various solvent systems and zone drawing also have been attempted with polyamide films and fibers; however, the results in terms of tensile properties were inferior to those seen with dry and gel spinning. See Hancock, T. A. et al., *J. Appl. Polym. Sci.,* 21, 1227-1247 (1977); U.S. Pat. No. 4,379,773 to Danzik, M. et al.; Kunugi, T., et al., *Polymer,* 23, 1193-1198 (1982); Kunugi, T., et al., *Polymer,* 23, 1199-1208, (1982); Kunugi, T. et al., *Polymer,* 24,1983-1987 (1983).

Hence, there is a need for a process of manipulating the internal structure of polyamides, for example, by temporarily disrupting the intermolecular hydrogen bonding between the polymer chains, thereby disallowing the chains to crystallize in the spun fiber. Ideally, it would be preferable that the hydrogen bonding be allowed to reoccur at a later stage to develop crystallinity in the drawn fibers. It was initially thought that such hydrogen bond disruption could be accomplished by using an appropriate plasticizer. Indeed, several processes have been developed to suppress hydrogen bonding in polyamides and improve their ductility. A disadvantage of a plasticizer, however, is that after processing it remains in the polymer, affecting its properties (e.g., lower modulus and melting point). Nonetheless, reduction in the plasticization of nylon 6 has been shown with the use of ammonia (see Zacharadies, A., and Porter, R. S., *J. Polym. Sci: Polym. Let. Ed.,* 17, 277-279 (1979); Zacharadies, A. and Porter, R. S., *J. Appl Polym Sci,* 24, 1371 (1979); Kunugi, T. et al., *J. Polym. Sci. Polym. Phys. Edn.,* 20, 1485, (1982)) and iodine (see Chuah, H. H., and Porter, R. S., *Polymer,* 27, 241, (1986); Arimoto, H., et al., *J. Polym. Sci., A,* 3, 317-326 (1965); Vogelsong, D. C., *J. Polym. Sci., A,* 1, 1055-1068 (1963); Fraver, P. D., et al., *J. Macromol. Sci., Phys*, B6, 129 (1972); Abu-Isa, I., *J. Polym. Sci., A,* 9, 199-216 (1971)).

Upon treatment of nylon with potassium iodide (KI), the hydrogen bonds in both crystalline and amorphous regions are interrupted and hence there is considerable chain mobility in the nylon 6/iodine complex. The structure of iodinated nylon 6 has been investigated and there was found to be a marked difference between the carbonyl NMR peak of the iodinated nylon and that of the pure nylon, and it was suggested that this resulted from a conformational change in the methylene carbons adjacent to the amide (i.e., the CONH group). See Murthy, N. S., et al., *Macromolecules,* 23, 1342-1346 (1990); Murthy, N. S., *Macromolecules,* 20, 309-316 (1987); Burzynsk, R., et al., *J. Polym. Sci., Polym. Phys. Edn.,* 1986, 24, 133-141 (1986); Murthy, N. S., et *al., J. Polym. Sci., Polym., Phys. Edn.,* 1985, 23, 369-2376 (1985).

Similar reduction in the crystallization rate of aliphatic polyamides has been shown to occur by using inorganic salts like lithium halides. The addition of small amounts of LiCl changes the crystallization rate, melting rate, and melt viscosity of the polyamides; and drawing fibers prepared by melt spinning of polyamide/metal halide mixtures has led to the formation of fibers with increased moduli in the range of 9-14 GPa. See Acierno, D., et al., *J. Polym. Sci., Polym. Lett. Edn.,* 15, 323, (1977); Valenti, B., et al., *J. Phys. Chem.,* 77, 389-395 (1973); Bianchi, E., et al., *Macromolecules,* 7, 495-500 (1974); Valenti, B., et al., *Macromolecules,* 9, 117-122 (1976); Acierno, D., et al., *J. Polym. Sci. Polym. Symp.,* 54, 259-269 (1976); Acierno, D. and Lamantia, F. P., *J. Polym. Sci. Polym. Phys. Edn.,* 17, 1903-1912 (1979).

Recently, Wu and his coworkers studied the interaction between nylon 6,6 and nylon 6 with copper and lithium salts. See Xie, A. F., et al., *Journal of Molecular Structure,* 613, 67, (2002); Wu, Y., et al., *J. of App. Polym. Sci.,* 91, 2869 (2004); Xu, Y. Z., et al., *J. of App. Polym. Sci.,* 77, 2685, (2000). Based on their results, they proposed a coordinating model between the metal ions and the amide group. The metal ion, which plays a crosslinking role, coordinates with amide groups from different sites and/or from different polymer chains and makes the parallel-aligned structure unstable. Consequently, the polymer chain adopts a new conformation in which the conformation and the hydrogen bond arrangement of the amide group may be similar to that of alpha-helix or coil in proteins rather than the beta-sheet like structure in the pure polymer.

Further, Roberts and Jenekhe have demonstrated that aliphatic polyamides can undergo complex formation with strong Lewis acids such as $GaCl_3$, $BF_3$, $BCl_3$, and $AlCl_3$ in view of the Lewis base sites (—NH—CO—) in the polymers. See Roberts, M. F., and Jenekhe, S. A., *Macromolecules,* 24, 3142, (1991); Roberts, M. F., and Jenekhe, S. A., *Chem. Mater.,* 2, 224, (1990); Roberts, M. F., and Jenekhe, S. A., *Polymer Preprints* (*American Chemical Society, Division of Polymer Chemistry*), 31, 480, (1990). The Lewis-acid acts like a plasticizer in the complex. Complete suppression of the intermolecular hydrogen bonds was achieved by the 1:1 Lewis acid complexation of the basic oxygen sites of the carbonyl groups in the polymers, thus liberating the N—H groups from hydrogen bonding. The complexation of nylon 6 can be accomplished in nitromethane. Generally, the non-complexed nylon 6 polymer does not dissolve in nitromethane.

III. Films and Fibers from $GaCl_3$/Nylon 6,6

Subsequent to the work of Roberts and Jenekhe with nylon 6, Vasanthan et al., made the complexes of $GaCl_3$-nylon 6,6 in nitromethane and measured the drawability of the films and fibers prepared from the complex. See Vasanthan, N., et al., *Polymer,* 45, 4077, (2004); Vasanthan, N, et al., *Polymeric Materials: Science and Engineering,* 91, 354, (2004); Vasanthan, N., et al., *Polymer Preprints* (*American Chemical Society, Division of Polymer Chemistry*), 45, 787, (2004). Nylon 6,6 complexed films were drawn up to a draw ratio of 40. Soaking the film in water for 24 hours leads to the decomplexation of the $GaCl_3$/nylon, resulting in regenerated nylon material, leaving only traces of gallium chloride and restored hydrogen bonding. To remove all the gallium chloride, films were soaked in water for at least 72 hours.

X-ray diffraction (XRD) scans of the complexed films indicated that the films are totally amorphous and rubbery with a structure that appears stable to at least 200° C. with no degradation. The Tg of the complexed film is −32° C. FTIR and $^{13}$C-NMR observations indicated that the Ga metal cations form a 1:1 complex with the carbonyl oxygens of the nylon 6,6 amide groups. See Vasanthan, N. et al., *Polymer,* 45, 4077, (2004).

Initial attempts at preparing fibers from the $GaCl_3$/nylon complex material used the dry-jet wet spinning technique. The complexed filaments were drawn at a draw ratio of up to 7, and following decomplexation the nylon 6,6 fibers had a 23.7 initial modulus and a 1.31 GPa tenacity, the highest previously reported values for nylon 6,6 fibers. See Jung, D., et al., Abstracts of Papers, 228th ACS National Meeting, Aug. 22-26, 2004.

From these initial attempts to prepare high modulus fibers, further experimentation, as described herein below in the Examples, brought to light additional steps in the presently described process, which currently provides fibers with an initial modulus of up to about 30.1 GPa.

EXAMPLES

The following Examples have been included to illustrate modes of the presently disclosed subject matter. Certain aspects of the following Examples are described in terms of techniques and procedures found or contemplated by the present co-inventors to work well in the practice of the presently disclosed subject matter. In light of the present disclosure and the general level of skill in the art, those of skill will appreciate that the following Examples are intended to be exemplary only and that numerous changes, modifications, and alterations can be employed without departing from the scope of the presently disclosed subject matter.

Example 1

Nylon 6,6/$GaCl_3$ Complexes 1.1 General Considerations

High modulus nylon 6,6 fibers are produced by using a Lewis acid complexation method with high molecular weight nylon 6,6 (up to 175,000 g/mol). High draw ratios can be obtained by careful stretching of the complexed fibers, which are made by using dry-jet wet spinning. The complexed fibers can be stretched easily because there is no hydrogen bonding in these filaments. The presently disclosed subject matter demonstrates that nylon 6,6 fibers made from a high molecular weight polymer can reach initial moduli up to about 30.1 GPa and tenacities of about 2.5 GPa.

1.2 Preparation of High Molecular Weight Nylon 6.6

High molecular weight nylon 6,6 is obtained by using solid-state polymerization. The polymerization occurs in a specialized reaction apparatus, which consists of a long, straight tube having a neck and downward sidearm as shown in FIG. 1. The top neck of the tube is used for $N_2$ input and/or vacuum application. The $N_2$/vacuum switch consists of a manifold above the tube with dual-valve stopcocks. The sidearm is connected to a small round bottom flask and a $N_2$/vacuum output. This thin tube (outer diameter of 1.78 cm, length of 24 cm) holds the polymer while it undergoes solid-state polymerization in the vapor bath of a boiling liquid. The vapor bath is contained in a larger tube with an upward sidearm and the smaller tube is held just above the boiling liquid's surface (where the temperature is the most constant). The larger tube is heated by a Precision™ heater, and contains boiling stones to prevent vigorous boiling. Suitable compounds for use as solvents for the vapor bath include, but are not limited to, methyl salicylate, decyl alcohol, diethylene glycol, and biphenyl.

About 5 to 10 grams of nylon 6,6 (available from E. I. du Pont de Nemours and Company, Wilmington, Del., United States of America) is placed into the polymerization tube. The tube is connected to the $N_2$/vacuum manifold, and all joints are sealed with a high-vacuum grease. The tube is then purged of any air present by reducing the pressure to about 0.5-0.6 Torr and refilling with nitrogen. This switching process is repeated 2-3 times, and finally ends with the tube under vacuum. The pressure is slowly lowered to about 0.2-0.3 Torr. The tube is then placed into the desired vapor bath for specified times. After completion of polymerization the samples are cooled to room temperature under nitrogen flow. In a typical experiment conducted at 255° C. for 8 hours, the molecular weight of nylon 6,6 is 174,000 g/mole.

The viscosity averaged molecular weight is calculated from the Mark-Houwink equation:

$$[\eta]=KMW^{a}$$

The constants K and a values used for the nylon 6,6/formic acid system at 25° C. are 35.3×10-5 dL/g and 0.786, respectively. The viscometric measurements are conducted at 25° C. by using an Ubbelohde viscometer. The limiting viscosity number can be determined from the following equation (1):

$$[\eta] = \frac{2}{C}(\eta_{rel}^{1/2} - 1) \quad (1)$$

where C is polymer concentration.

1.3. Preparation of Spinning Dope

Complex solutions ($GaCl_3$ /nylon 6,6) are made in nitromethane in the range of temperature from about 65° C. to about 70° C. for 24 hours with mechanical stirring. $GaCl_3$ and nitromethane were obtained from Aldrich (Milwaukee, Wis., United States of America). In a typical experiment, anhydrous gallium chloride, $GaCl_3$ (5 grams, 0.0284 mole) is added to nitromethane (64 grams) in a 250-mL round bottom flask equipped with a mechanical stirrer in a dry (nitrogen flow) glove box, and then nylon 6,6 chips (3.2 grams, 0.0142 mole) are added to the gallium chloride solution. The flask is then immediately placed in an oil bath stirring beginning at about 120 rpm as the bath temperature is gradually increased to about 65° C. The nylon chips start swelling slowly and the viscosity of the mixture becomes very high after about 3 hours. At this point, the stirring speed is reduced to about 50 rpm for the remainder. Stirring of the mixture is continued for 24 hours to assure the complete dissolution of nylon 6,6 chips. A 1:1 stoichiometric ratio of $GaCl_3$ to amide groups was found to achieve complete suppression of hydrogen bonding in nylon 6,6 as well as complete dissolution of the polymer. Lower ratios usually resulted in undissolved (uncomplexed) nylon chips.

In representative, non-limiting embodiments of the presently disclosed subject matter, two different molecular weights of nylon 6,6 are used for preparing the complexation solution: 30,000 g/mol and 175,000 g/mol molecular weight. Low molecular weight nylon 6,6 was received from DuPont Co. (E. I. du Pont de Nemours and Company, Wilmington, Del., United States of America). In some embodiments, a complexation solution prepared from low molecular weight nylon 6,6 is used to make complex films. In some embodiments, high molecular weight nylon 6,6 is used for making complex fibers.

Complexed films are made by evaporating the solvent under vacuum at room temperature. Preferably, the solvent is evaporated slowly to minimize the formation of bubbles. To obtain a clean and smooth film surface, any bubbles should be removed during evaporation. The complexed film can be stretched when it is pulled by both hands at room temperature. A Teflon-coated Petri dish is used to reduce and minimize adhesion of the complexed film.

The glass transition temperature of the complexed film is about −32° C. A super high draw ratio up to 40 was demonstrated at room temperature. Generally, nylon 6,6 cannot be drawn more than 5 times because of strong intermolecular hydrogen bonding present between the amide linkages in nylon 6,6. When the polymer is complexed with gallium chloride the hydrogen bonding is fully eliminated and therefore, it is possible to reach these very high draw ratios. Decomplexed film can be obtained by soaking the complexed films in water.

1.4. Fiber Spinning

The complex solution (after complexation and dissolution of nylon 6,6 is complete) is maintained for at least one day at room temperature under nitrogen to remove any remaining bubbles in the complex solution. The bubbles should be removed before spinning.

The spinnability of a polymer solution can be determined by immersing a small spatula or a glass rod in the polymer solution and pulling it upwards. Generally, a liquid jet will form if a polymer solution has fiber-forming properties. If viscosity is too low then dripping occurs.

Figure 2:
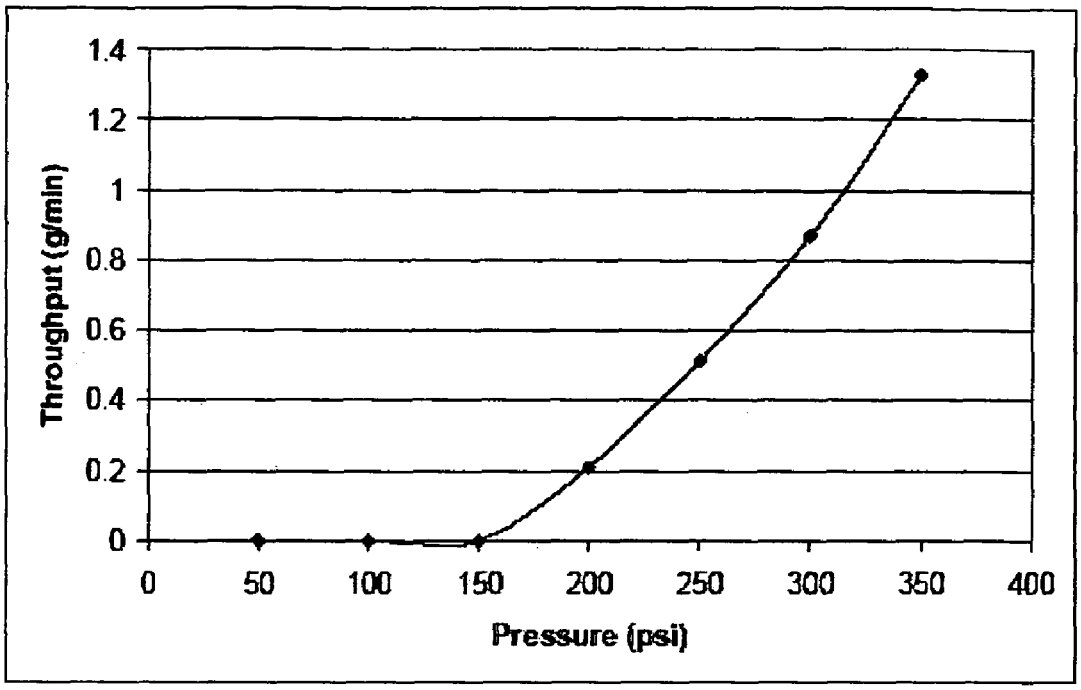
FIG. 2 is a graph of the throughput of a $GaCl_3$/nylon 6,6 complex solution as a function of pressure.

The throughput can be measured to determine the optimum pressure range for spinning the complex spinning solution. FIG. 2 shows the throughput of $GaCl_3$/nylon 6,6 complex solutions at various pressures using a spinneret having an orifice diameter of 0.01 inches and an orifice length of 0.02 inches. At room temperature, the throughput increases with an increasing pressure. As shown in FIG. 2, the complex solution is too thick to flow in the range from 50 to 150 psi. Under pressures higher than 150 psi, however, some small amount of the polymer solution can be collected. Preferably, the spinning temperature should be higher than room temperature to assure adequate flow of the complex solution. At higher temperatures, lower viscosities are expected and therefore the appropriate higher flow rate could produce filaments.

Figure 3:
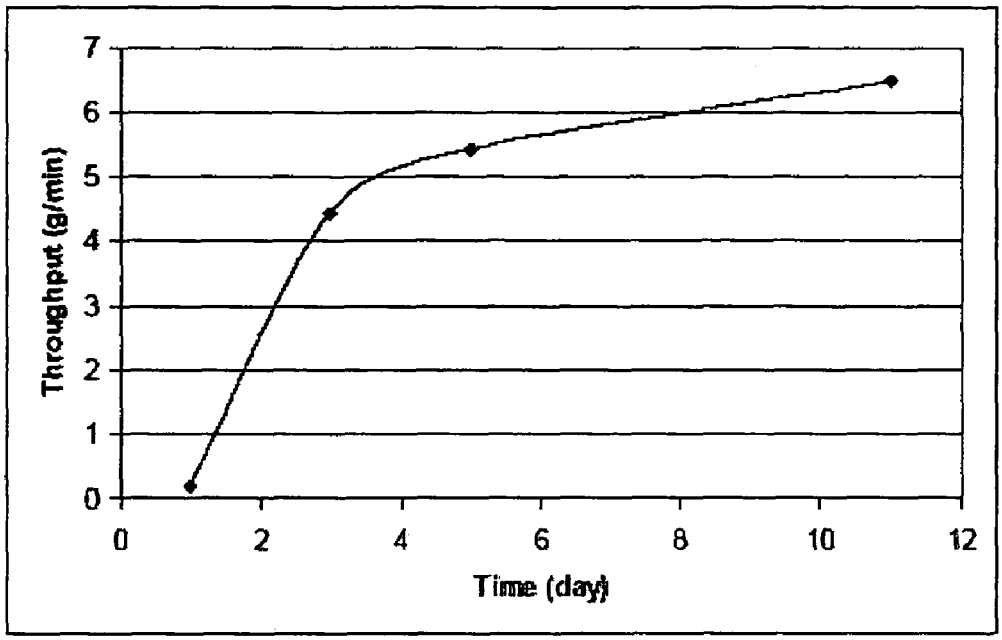
FIG. 3 is a graph of the throughput of a $GaCl_3$/nylon 6,6 complex solution as a function of time.

FIG. 3 shows the throughput of $GaCl_3$/nylon 6,6 complex solutions as a function of time. The throughput dramatically increases 2 to 4 days after preparing the $GaCl_3$/nylon 6,6 complex and tends to level off thereafter. Without wishing to be bound to any one particular theory, this type of rheological instability can be explained by interaction of $GaCl_3$ with moisture during the experiment. Therefore, it is preferable to prepare and handle the complex nitromethane solution in the presence of nitrogen to prevent moisture absorption.

Further, the choice of coagulant can influence the efficacy of the wet spinning process. To coagulate the nylon 6,6/$GaCl_3$ complexed fiber, various protic solvents, such as methanol, ethanol, n-propanol, 2-propanol, n-butanol, acetone and water, were investigated. 2-propanol was selected as the one solvent that is most suitable for the coagulation of the complex.

Figure 4:
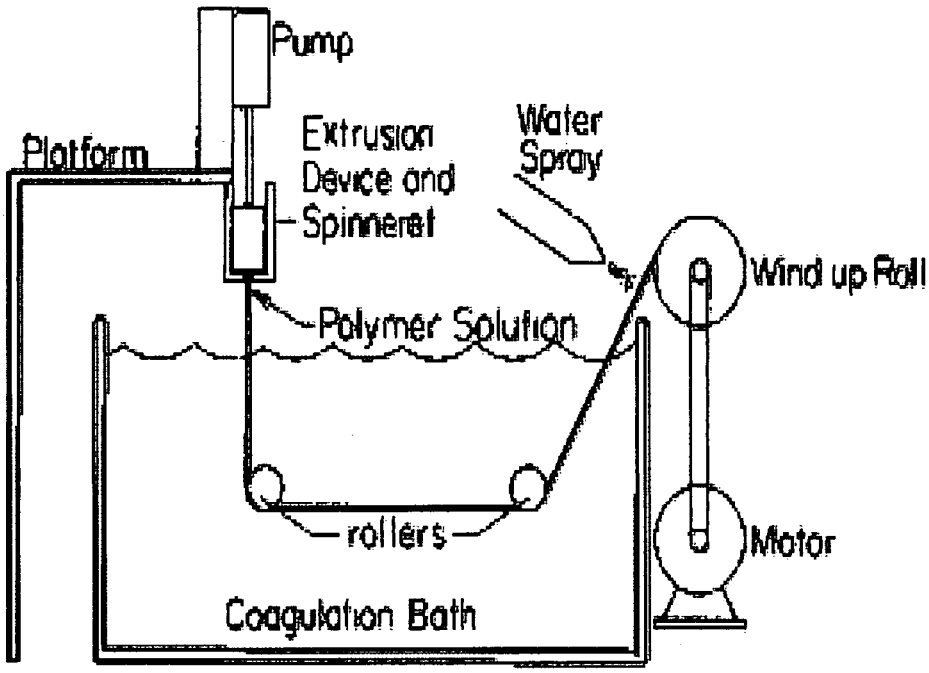
FIG. 4 is a schematic diagram of a dry-jet, wet spinning apparatus suitable for use with the presently disclosed subject matter.

A dry-jet wet spinning method is used to achieve filament orientation. A representative apparatus for use with the presently described method is provided in FIG. 4. In some embodiments, the gap length between the spinneret and the coagulation bath is 2 inches. The dimension of coagulant bath is 10.5 cm×9 cm×91 cm. The cylinder containing the spinning dope is insulated to prevent heat losses and rapid changes in viscosity. The cylinder capacity is 2.15 cm in diameter×15.2 cm in length and is equipped with a single orifice. The dry-jet wet spinning method is typically used for making Kevlar® (E. I. du Pont de Nemours and Co., Wilmington, Del., United States of America) fiber, and differs from conventional wet spinning. In conventional wet spinning, the spinneret typically is located in the coagulation bath. In a dry-jet wet spinning, however, the spinneret is located above the coagulation bath.

The dry-jet spinning method offers two advantages. One advantage is that the spinning temperature can be preserved during the spinning processing. In some embodiments of the presently disclosed method, the spinning temperature is about 65° C. and the coagulation bath temperature is about 25° C. If spinneret is in the coagulation bath, it can be difficult to maintain the spinning temperature. The other advantage of the dry-jet spinning method is that, due to the air gap in the dry-jet spinning system, filament orientation occurs.

In some embodiments, 4.5 wt. % nylon 6,6 complex solutions are poured into a small cylinder that is heated to 65° C. One end of the cylinder is connected to a nitrogen gas tank and the other end of the cylinder is blocked with a one-hole spinneret. In some embodiments, the orifice dimensions are 0.01 inches in diameter and 0.02 inches in length, which provides an orifice length: diameter ratio of 2. In some embodiments, the spinning temperature is about 65° C., and extrusion pressure is about 150 psi. The continuous filament is passed through the coagulant bath, which in some embodiments contains isopropanol, and is collected on a glass frame, e.g., a rectangular glass frame. Then, the complex filaments are dried at room temperature in an environment that was essentially free of any moisture. The drying time, which was found to affect the stretchability of the filaments, was varied from 6 hours to 10 days. The optimal time was found to be between about 1 to about 2 days. Drying times longer than 10 days resulted in brittle fibers, which could not be drawn at all.

1.5 Drawing and Properties of Filaments

The complex filaments made from the presently disclosed method are drawn by using a MTS tensile tester (Material Testing System Corporation, Eden Prairie, Minn., United States of America) with drawing rates from about 0.1 to 2 inch/min. Complex filaments are cut into lengths more than 3 inches and mounted on the tensile tester between a one-inch cross head gap. The draw ratios of complex filaments prepared by the presently disclosed method exhibit various ranges from 2.1 to 7.12 (see Table 1).

Without wishing to be bound to any one particular theory, these different draw ratios appear to be related to the morphology of the complex filaments. Cross sections of regenerated nylon 6,6 fibers were observed with a Hitachi S-3200N Scanning Electron Microscope (SEM) (Hitachi High Technologies America, Inc., Schaumberg, Ill., United States of America). Fiber samples were submerged in liquid nitrogen and were cut with a razor blade. When the dry-jet wet spun complex filaments have an even thickness and shape, high draw ratios are obtained. Whereas if the shape of the dry-jet wet spun complex filaments is not even or has an irregular external appearance, then low draw ratios are obtained. The complex filaments are very weak and can be easily stretched compared to melt spun nylon 6,6 fibers due to complete suppression of hydrogen bonding.

High draw ratios with complexed filaments can be obtained at 0.2-inch/min strain rate. The stretched complex filaments are fixed on the glass frame, e.g., a rectangular glass frame, and then soaked in water for 24 hours to remove $GaCl_3$. Decomplexed or regenerated high draw nylon 6,6 filaments were prepared for tensile testing. Initial moduli of these regenerated filaments were dramatically high. Commercial nylon 6,6 filaments typically have initial moduli of about 6 GPa, which was increased about 5 times for the fibers regenerated from the nylon 6,6/$GaCl_3$ complex.

The initial modulus increased as the draw ratio increased. The draw ratio range varied from about 4 to about 7, and depended on the morphology of the spun filaments. All regenerated filaments were broken at low strain levels. This observation indicates that the regenerated filaments were highly oriented at draw ratios from about 4 to about 7. Also the measured tenacity values exhibit very high values.

Figure 5:
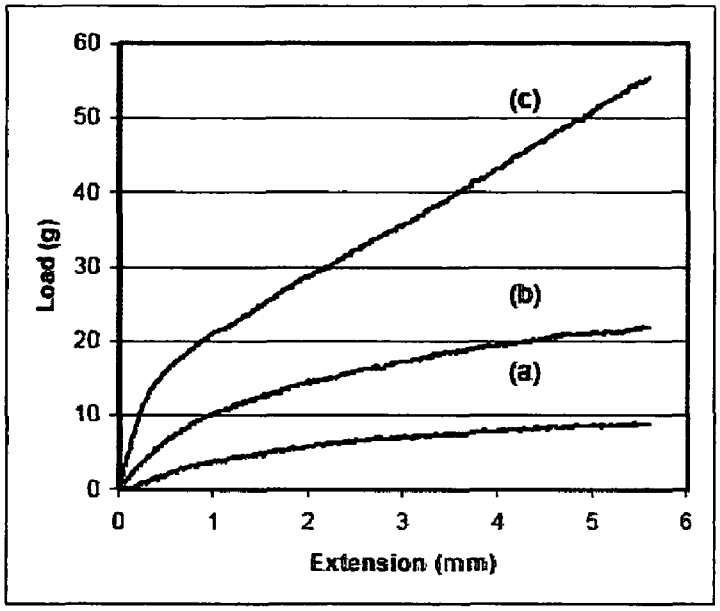
FIG. 5 is a load-extension graph for regenerated nylon 6,6 filaments at draw ratios of: (a) 2.5, (b) 4.5, and (c) 7.1.
Figure 6:
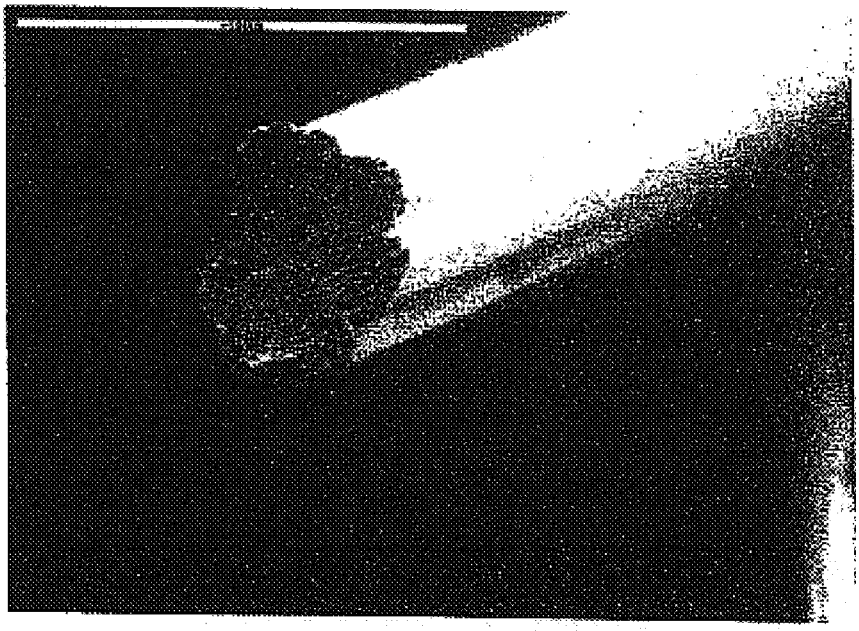
FIG. 6 is a scanning electron micrograph of the cross section of a regenerated nylon 6,6 filament at a draw ratio of 4.5.

FIG. 5 shows exemplary load and extension graphs observed for the regenerated nylon 6,6 filaments. Initial modulus can be calculated from the initial slope of each graph. Initial modulus increased with increasing draw ratio. At a draw ratio of 7, the initial slope was high compared to those fibers with lower draw ratios. This high draw ratio (see Table 1) can be obtained by careful drawing of complexed fibers, which have no hydrogen bonding between their nylon 6,6 chains. As shown in Table 2 regenerated nylon 6,6 fibers showed an enormously high initial modulus of 30.1 GPa at a draw ratio of 7.2. The SEM cross section of the high modulus regenerated nylon 6,6 fiber is shown in FIG. 6. The cross section is highly dependent on spinneret shape. The cross section of the fiber shown in FIG. 6 is not perfectly round in shape, but is largely round and slightly fluted.

TABLE 1

Draw Ratio of $GaCl_3$/High Molecular Weight Nylon 6,6 Complex Filaments Obtained with Different Strain Rates.

| Sample | Draw ratio: Strain rate (0.5 inch/min) | Draw ratio: Strain rate (0.2 inch/min) |
|---|---|---|
| 1 | 4.3 | 5.5 |
| 2 | 4.1 | 5.8 |
| 3 | 3.5 | 5.5 |
| 4 | 4.8 | 5.1 |
| 5 | 2.6 | 6.2 |
| 6 | 3 | 7.12 |
| 7 | 3.05 | 7.2 |
| 8 | 3.55 | 7.2 |
| 9 | 3.59 | |
| 10 | 2.1 | |
| 11 | 3.5 | |
| 12 | 4.2 | |
| 13 | 4.5 | |
| 14 | 4.3 | |
| 15 | 3.18 | |
| 16 | 4.3 | |
| 17 | 4.2 | |
| 18 | 3.5 | |
| 19 | 4 | |
| 20 | 4.82 | |
| 21 | 4.99 | |
| 22 | 3 | |
| 23 | 4.56 | |
| 24 | 4.54 | |
| 25 | 3.3 | |
| 26 | 4.9 | |
| 27 | 4.9 | |
| 28 | 4.5 | |
| 29 | 4.9 | |
| 30 | 5 | |

TABLE 2

Tensile Properties of High Modulus/High Tenacity Nylon 6,6 Filaments.

| Sample | Denier (d) | Draw ratio | Strain @ break (%) | Yield load (g) | Initial modulus (GPa) | Tenacity (GPa) |
|---|---|---|---|---|---|---|
| 1 | 1.25 | 4.1 | 23.65 | 13.45 | 15.86 | 1.09 |
| 2 | 1.25 | 4.2 | 37.64 | 14.91 | 18.06 | 1.21 |
| 3 | 1.8 | 4.3 | 46.10 | 22.04 | 16.34 | 1.39 |
| 4 | 1.13 | 4.5 | 54.23 | 18.82 | 14.76 | 1.38 |
| 5 | 1.87 | 4.8 | 41.55 | 16.86 | 15.22 | 0.91 |
| 6 | 1.22 | 4.9 | 27.66 | 12.95 | 15.62 | 1.07 |
| 7 | 1.22 | 4.8 | 19.70 | 13.20 | 18.84 | 1.10 |
| 8 | 1.33 | 4.9 | 56.20 | 22.73 | 13.96 | 1.78 |
| 9 | 3.07 | 5.8 | 24.61 | 94.36 | 20.61 | 1.68 |
| 10 | 1.8 | 6.2 | 26.23 | 22.98 | 26.98 | 1.29 |
| 11 | 3.07 | 7.12 | 28.96 | 36.67 | 24.73 | 1.31 |
| 12 | 1.12 | 7.2 | 52.53 | 26.88 | 30.14 | 2.50 |
| 13 | 1.12 | 7.2 | 45.20 | 22.73 | 23.16 | 2.04 |

Example 2

Nylon 6,6/$CaCl_2$ and Methanol System

In some embodiments, the presently disclosed subject matter provides a method for preparing nylon 6,6 fibers from complexes of nylon 6,6 formed in a $CaCl_2$/methanol system. Details of the $CaCl_2$/methanol system are shown in Table 3.

TABLE 3

$CaCl_2$/Methanol System.

| $CaCl_2$ (%) | Nylon 6,6 (MW ~175,000 g/mole) (%) | Complexation ratio ($CaCl_2$:amide group) | Time (days) | Comments |
|---|---|---|---|---|
| 25 | 2.5 | 10:1 | 1 | Viscosity too low, added polymer |
| 24.36 | 5 | 5:1 | 2¼ | Added more polymer |
| 23.86 | 7 | 3.5:1 | ½ | Added more $CaCl_2$ as undissolved polymer left |
| 30 | 5.12 | 6:1 | 2½ | At RT, undissolved polymer and uncomplexed $CaCl_2$ left |
| " | " | " | 1 | Stopped stirring but kept on heating |

The data provided in Table 3 suggest that the concentrations of the $CaCl_2$ and nylon 6,6 must be adjusted to achieve the appropriate complexation ratio (Lewis acid: amide group). Accordingly, a solution was prepared with the same system but with a lower molecular weight polymer. Details from this experiment are provided in Table 4.

TABLE 4

$CaCl_2$/Methanol system

| $CaCl_2$ (%) | Nylon 6,6 (MW ~100,000 g/mole) (%) | Complexation ratio ($CaCl_2$:amide group) | Time (days) | Comments |
|---|---|---|---|---|
| 20 | 5 | 4:1 | 3 | Added more polymer |
| 19.6 | 7 | 3:1 | 2½ | Stopped stirring and kept on heating for 2 days, uncomplexed $CaCl_2$, so added polymer |
| 18.42 | 12.52 | 1.5:1 | 3 | Stopped stirring and kept on heating |

From the complex solution prepared according to the method describe in Table 4, fiber spinning was tried at a temperature of about 60° C. using isopropanol for the coagulant bath. The fiber spinnability was very good but the fiber was weak and the coagulation also was not uniform from center to surface. Attempts were made to evaporate the solvent, i.e., methanol, and then spin the remaining solution, but the viscosity became very high and, even at a temperature of 80-90° C., fiber could not be spun.

Example 3

Nylon 6,6/LiCl and Formic Acid System

The presently disclosed subject matter also provides a method for forming nylon 6,6 fibers from a complex of nylon 6,6 in an LiCl/formic acid system. The details of this system are provided in Table 5.

TABLE 5

LiCl and Formic Acid System.

| LiCl (%) | Nylon 6,6 (MW ~100,000 g/mole) (%) | Complexation ratio (LiCl:amide group) | Time (days) | Comments |
|---|---|---|---|---|
| 20 | 5 | 11:1 | ¾ | Added more polymer |
| 15 | 13.43 | 3:1 | 2¼ | Added more polymer |
| 13.79 | 20 | 1.83:1 | ¾ | Added more polymer |
| 13.24 | 23.17 | 1.5:1 | ¼ | Added more polymer |
| 11.82 | 31.43 | 1:1 | 1 | Kept at RT, allowed air bubbles to settle down for 2 days |

After 2 days, attempts were made to spin fiber from the solution. Several coagulating protic solvents, including isopropanol, methanol, ethanol, butanol, 1-propanol, water, and water/methanol solutions (e.g., 5/95%, 10/90%, 50/50%, 65/35%, 60/40%, 55/45%, and 75/25%) were investigated. The fiber was observed to coagulate the fastest in water only, but is very weak. Further, in all other pure solvents, the fiber coagulates very slow and also is very weak. Without wishing to be bound to any one particular theory, it is believed that under these conditions the polymer molecular weight is too low for fiber formation.

Example 4

Solid State Polymerization

Solid-state polymerization (SSP) of nylon 6,6 chips can be done in a vacuum oven. The temperature of the vacuum oven is increased from room temperature to about 238° C. (SSP1) and about 260° C. (SSP2) with nylon 6,6 chips, respectively. The solid-state polymerization time was 9 hours at both temperatures. The molecular weight of nylon 6,6 chips was determined to be about approximately 100,000 g/mol at both temperatures.

The other solid-state polymerization was done after increasing temperature. That is, the temperature of the vacuum oven is increased to about 255° C. (SSP3) and then nylon 6,6 chips were put in and kept for 9 hours. In this case, the molecular weight of the nylon 6,6 chips reached about approximately 170,000 g/mol.

Scheme 1. Temperature history.

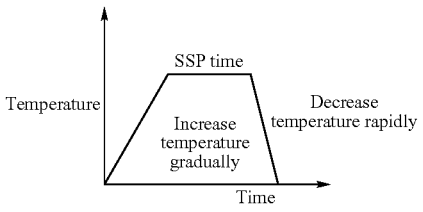

REFERENCES

The references listed below as well as all references cited in the specification are incorporated herein by reference to the extent that they supplement, explain, provide a background for or teach methodology, techniques and/or compositions employed herein. All cited patents and publications referred to in this application are herein expressly incorporated by reference.

Abu-Isa, I., *J. Polym. Sci., A*-1, 9, 199-216 (1971).
Acierno, D., et al., *J. Polym. Sci. Polym. Symp.* 54, 259-269 (1976).
Acierno, D., et al., *J. Polym. Sci., Polym. Lett. Edn.,* 15,323, (1977).
Acierno, D., and Lamantia, F. P., *J. Polym. Sci. Polym. Phys. Edn.,* 17, 1903-1912 (1979).
Arimoto, H., et al., *J. Polym. Sci., A,* 3, 317-326 (1965).
Bianchi, E., et al., *Macromolecules,* 7, 495-500 (1974).
Burzynsk, R., et al., *J. Polym. Sci., Polym. Phys. Edn.,* 24,133-141 (1986).
Cho, J. W., et al., *J. Appl. Polym. Sci.,* 62, 771-778 (1996).
Chuah, H. H., and Porter, R. S., *Polymer,* 27, 241-246, (1986).
Chuah H. H., and Porter, R. S. *Polymer,* 27, 1022-1029, (1986).
Ciferri, A., and Ward, I. M., Eds., *Ultra-High Modulus Polymers* (London: Applied Science, 1979).
Danzik, M., et al. U.S. Pat. No. 4,379,773, Apr. 12, 1983.
Frayer, P. D., et al., *J. Macromol. Sci., Phys*, B6, 129 (1972).
Gogolewski, S., Techn. Res. Report, No. 1, (1979), in Polish.
Gogolewski, S., and Pennings, A. J., *Polymer,* 26,1394, (1985).
Gogolewski, S., and Pennings, A. J., *J. Appl. Polym. Sci.* 28, 1045-1061 (1983).
Hancock, T. A., et al., *J. Appl. Polym. Sci.,* 21,1227-1247 (1977).
Jung, D., et al., *Abstracts of Papers, 228th ACS National Meeting*, Aug. 22-26, 2004.
Kunugi T., et al., *J. Appl. Polym. Sci.,* 67,1993-2000 (1998).
Kunugi, T., et al., *J. Polym. Sci. Polym. Phys. Edn.,* 20, 1485, (1982).
Kunugi, T., et al., *Polymer,* 23, 1193-1198 (1982).
Kunugi, T., et al., *Polymer,* 23,1199-1203 (1982).
Kunugi,T., et al., *Polymer,* 24,1983-1987 (1983).
Kunugi, T., et al., *Polym prepr., Am Chem Soc.,* 20, 778 (1979).
Kwon, Y. D., etal., European Patent Appl. 0,144,793, Jun. 19, 1985.
Kwon, Y. D., et al., U.S. Pat. No. 4,440,711, Apr. 3, 1984.
Leenslag, J. W., and Pennings, A. J., *Polymer,* 28,1695-1702 (1987).
Murthy, N. S., *Macromolecules,* 20, 309-316 (1987).
Murthy, N. S., et al., *J. Polym. Sci., Polym., Phys. Edn.,* 23, 2369-2376 (1985).
Murthy, N. S., et al., *Macromolecules,* 1990, 23,1342-1346 (1990).
Pennings, A. J., et al., *Pure Appl. Chem.,* 55, 777-798 (1983).
Postema, A. R., and Smith, P., *Polym. Commun.,* 31, 444, (1990).
Predecki, P. and Statton, W. O., *J. Polym. Sci., Polym. Lett. Ed.,* 10, 87 (1972).
Roberts, M. F., and Jenekhe, S. A., *Chem. Mater.,* 2, 224, (1990).
Roberts, M. F., and Jenekhe, S. A., *Polymer Preprints (American Chemical Society, Division of Polymer Chemistry)*, 31, 480, (1990).
Roberts, M. F., and Jenekhe, S. A., *Macromolecules,* 24, 3142, (1991).
Seidal, A. et al., *Macromolecules,* 33, 775, (2000).
Smith, P. et al., *Polym. Bull.,* 1979, 1, 733-736 (1979).
Smith, P., and Lemstra, P. J., *Makromol. Chem,* 180, 2983, (1979).
Smith, P. and Lemstra, P. J., *J. Mater. Sci.,* 15, 505-514 (1980).
Smook, J., et al., *Appl. Polym. Sci.,* 41,105-116, (1990).
Suzuki A., et al., *Polymer,* 39,1351-1355, (1998).
Suzuki A., and Endo, A., *Polymer,* 38, 3085, (1997).

Suzuki A., and ishihara M., *J. Appl. Polym. Sci.,* 83, 1711-1716, (2002).

Valenti, B., et al., *J. Phys. Chem.,* 77, 389-395 (1973).

Valenti, B., et al., *Macromolecules,* 9, 117-122 (1976).

Vasanthan, N., et al., *Polymer,* 45, 4077, (2004).

Vasanthan, N., et al., *Polymeric Materials: Science and Engineering,* 91, 354, (2004).

Vasanthan, N., et al., *Polymer Preprints* (*American Chemical Society, Division of Polymer Chemistry*), 45, 787, (2004).

Vogelsong, D. C., *J. Polym. Sci., A,* 1, 1055-1068 (1963).

Vollrath, F. and Knight, D. P., *Nature,* 410, 541, (2001).

Wijnenburg, A. and Pennings, A. J., *J. Colloid Polym Sci.,* 253, 452, (1975).

Wu, Y., et al., *J. of App. Polym. Sci.,* 91, 2869 (2004).

Xie, A. F., et al., *Journal of Molecular Structure,* 613, 67, (2002).

Xu, Y. Z., et al., *J. of App. Polym. Sci.,* 77, 2685, (2000).

Zachariades A. E., and Kanamoto T., *J. Appl. Polym. Sci.,* 35,1265, (1988).

Zachariades, A. E., and Porter, R. S., *J. Appl Polym Sci,* 24, 1371 (1979).

Zachariades, A. E., and Porter, R. S., *J. Appl Polym Sci.,* 24, 2137 (1979).

Zacharadies, A. E., and Porter, R. S., *J Polym. Sci: Polym. Let. Ed.,* 17, 277-279 (1979).

It will be understood that various details of the presently disclosed subject matter can be changed without departing from the scope of the presently disclosed subject matter. Furthermore, the foregoing description is for the purpose of illustration only, and not for the purpose of limitation.

What is claimed is:

1. A polyamide 6,6 fiber having an initial modulus of at least about 30 GPa and a tensile strength of at least about 2.5 GPa.

2. The polyamide fiber of claim 1, wherein the 6,6 has a viscosity averaged molecular weight of between about 160,000 g/mol and about 180,000 g/mol.

3. The polyamide fiber of claim 1, wherein the polyamide fiber has a draw ratio ranging from about 4 to about 7.5.

4. The polyamide fiber of claim 3, wherein the draw ratio has a range from about 7 to about 7.5.

* * * * *

UNITED STATES PATENT AND TRADEMARK OFFICE

CERTIFICATE OF CORRECTION

PATENT NO. : 7,666,499 B2
APPLICATION NO. : 11/528701
DATED : February 23, 2010
INVENTOR(S) : Jung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 564 days.

Signed and Sealed this

Seventh Day of December, 2010

David J. Kappos

David J. Kappos
*Director of the United States Patent and Trademark Office*